US007791322B2

(12) United States Patent
Zhou et al.

(10) Patent No.: US 7,791,322 B2
(45) Date of Patent: Sep. 7, 2010

(54) ECONOMICAL HIGH VOLTAGE DC TO LOW VOLTAGE DC CONVERTER

(75) Inventors: Hong-Bo Zhou, Shenzhen (CN); Tong Zhou, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 441 days.

(21) Appl. No.: 11/982,868

(22) Filed: Nov. 5, 2007

(65) Prior Publication Data

US 2008/0106244 A1 May 8, 2008

(30) Foreign Application Priority Data

Nov. 3, 2006 (TW) ..... 95140733 A

(51) Int. Cl.
*G05F 1/565* (2006.01)

(52) U.S. Cl. ..... 323/275; 323/303

(58) Field of Classification Search ..... 323/273, 323/275, 303

See application file for complete search history.

(56) References Cited

U.S. PATENT DOCUMENTS

| | | | | |
|---|---|---|---|---|
| 4,639,659 | A | 1/1987 | Okanobu | |
| 5,424,673 | A | 6/1995 | Edwards et al. | |
| 6,828,763 | B2 * | 12/2004 | Sudou et al. | 323/226 |
| 7,068,018 | B2 * | 6/2006 | Kanakubo | 323/274 |
| 7,589,507 | B2 * | 9/2009 | Mandal | 323/273 |
| 2005/0162141 | A1 * | 7/2005 | Kanakubo | 323/274 |
| 2007/0159146 | A1 * | 7/2007 | Mandal | 323/280 |
| 2008/0106244 | A1 * | 5/2008 | Zhou et al. | 323/273 |

* cited by examiner

*Primary Examiner*—Jeffrey L Sterrett
(74) *Attorney, Agent, or Firm*—Wei Te Chung

(57) ABSTRACT

An exemplary DC-DC converting circuit (2) includes an input terminal (20), a regulating circuit (21), a bleeder circuit (23), an output terminal (25), a voltage-controlling terminal (26), and a load (24). The input terminal, the regulating circuit, the bleeder circuit, and the output terminal are connected in series. The output terminal is grounded via the load. The voltage-controlling terminal is configured to supply a controlling voltage that controls the regulating circuit, and the bleeder circuit is configured to supply a stable divided voltage to the output terminal for output.

11 Claims, 3 Drawing Sheets

ECONOMICAL HIGH VOLTAGE DC TO LOW VOLTAGE DC CONVERTER

FIELD OF THE INVENTION

The present invention relates to direct current-direct current (DC-DC) converting circuits, and particularly to a DC-DC converting circuit for converting a high DC voltage to a low DC voltage.

BACKGROUND

At present, many electronic products are progressively being made more and more light, thin, power-saving, environment-friendly, and so on. Components in these electronic products may operate under various low DC voltages, such as 3.3 V, 2.5 V, 1.8 V, or the like. Therefore DC-DC converting circuits for converting high DC voltages to low DC voltages are widely used in power supply circuits of many electronic products, such as portable computer systems, liquid crystal display devices, and so on.

Referring to FIG. 5, a conventional DC-DC converting circuit 1 includes a three-terminal regulator 10, a first capacitor 11, a second capacitor 12, and a third capacitor 13. The three-terminal regulator 10 is an AIC1084-18CM type regulator, and includes an input pin 15, a grounding pin 16, and an output pin 17.

The first capacitor 11 has a capacitance of 0.1 μF. Two terminals of the first capacitor 11 are connected to the input pin 15 and the grounding pin 16, respectively. The second capacitor 12 has a capacitance of 0.1 μF. Two terminals of the second capacitor 12 are connected to the output pin 17 and the grounding pin 16, respectively. The third capacitor 13 is an electrolytic capacitor, which has a capacitance of 100 μF and a rated voltage of 16 V. The anode of the third capacitor 13 is connected to the output pin 17, and the cathode of the third capacitor 13 is connected to the grounding pin 16.

In operation, a high DC voltage is supplied to the DC-DC converting circuit 1 via the input pin 15 and converted to a low DC voltage by the three-terminal regulator 10. Then the low DC voltage is outputted via the output pin 17 as an output voltage. The first and second capacitors 11, 12 are used for compensating frequency to prevent the three-terminal regulator 10 from producing high frequency self-oscillation and high frequency noise. The third capacitor 13 is used for reducing low frequency interference at the output terminal 17 when the high DC voltage is supplied.

High precision, minute volume of the three-terminal regulator 10 is commercially available. However, the three-terminal regulator 10 is expensive as an integrated circuit. In such case, the cost of the DC-DC converting circuit 1 may be prohibitive.

What is needed, therefore, is a DC-DC converting circuit that can overcome the above-described deficiencies.

SUMMARY

In one aspect, a DC-DC converting circuit includes an input terminal, a regulating circuit, a bleeder circuit, an output terminal, a voltage-controlling terminal, and a load. The regulating circuit includes a transistor, and the transistor includes a base, an emitter, and a collector. The emitter is connected to the input terminal, the base is connected to the voltage-controlling terminal, and the collector is connected to the output terminal via the bleeder circuit. The output terminal is grounded via the load.

In another aspect, a DC-DC converting circuit includes an input terminal, a regulating circuit, a bleeder circuit, an output terminal, a voltage-controlling terminal, and a load. The regulating circuit includes a transistor, and the transistor includes a base, an emitter, and a collector. The collector is connected to the input terminal, the base is connected to the voltage-controlling terminal, and the emitter is connected to the output terminal via the bleeder circuit. The output terminal is grounded via the load.

In a further aspect, a DC-DC converting circuit includes an input terminal, a regulating circuit, a bleeder circuit, an output terminal, a voltage-controlling terminal, and a load. The input terminal, the regulating circuit, the bleeder circuit, and the output terminal are connected in series, and the output terminal is grounded via the load. The voltage-controlling terminal is configured to supply a controlling voltage that controls the regulating circuit, and the bleeder circuit is configured to supply a stable divided voltage to the output terminal for output.

Other novel features and advantages will become more apparent from the following detailed description when taken in conjunction with the accompanying drawings.

DETAILED DESCRIPTION OF PREFERRED EMBODIMENTS

Figure 1:
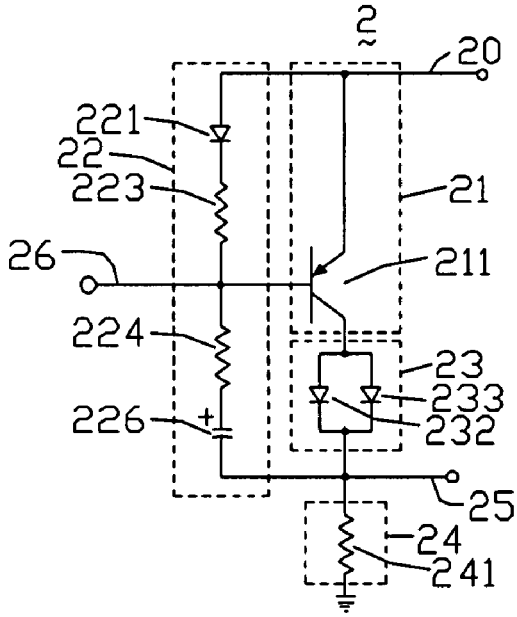
FIG. 1 is a diagram of a DC-DC converting circuit according to a first embodiment of the present invention.

Referring to FIG. 1, a DC-DC converting circuit 2 according to a first embodiment of the present invention is shown. The DC-DC converting circuit 2 includes an input terminal 20, a regulating circuit 21, a biasing circuit 22, a bleeder circuit 23, a load 24, an output terminal 25, and a voltage-controlling terminal 26.

The biasing circuit 22 includes a first diode 221, a first resistor 223, a second resistor 224, and a capacitor 226 connected in series. The first diode 221 includes an anode (not labeled) and a cathode (not labeled). The anode of the first diode 221 is connected to the input terminal 20, and the cathode of the first diode 221 is connected to the first resistor 223. The capacitor 226 may be an electrolytic capacitor, which includes an anode (not labeled) and a cathode (not labeled). The anode of the capacitor 226 is connected to the second resistor 224, and the cathode of the capacitor 226 is connected to the output terminal 25.

The regulating circuit 21 includes a transistor 211, and the transistor 211 includes a base (not labeled), an emitter (not labeled), and a collector (not labeled). The base of the transistor 211 is connected between the first and second resistors 223, 224, and is also connected to the voltage-controlling terminal 26. The emitter of the transistor 211 is connected to the input terminal 20. The collector of the transistor 211 is connected to the bleeder circuit 23.

The bleeder circuit 23 includes a second diode 232 and a third diode 233 connected in parallel. Each of the second and third diodes 232, 233 has an anode (not labeled) and a cathode (not labeled). The anodes of the second and third diodes 232, 233 are connected to the collector of the transistor 211, and the cathodes of the second and third diodes 232, 233 are connected to the output terminal 25.

The load 24 includes a third resistor 241. The output terminal 25 is grounded via the load 24.

The first, second, and third diodes 221, 232, 233 can be 1N4148 or 1N4448 type diodes. The second and third diodes 232, 233 preferably have a forward working voltage $V_d$ of 0.6 V. Also preferably, the first resistor 223 has a resistance of 100Ω, the second resistor 224 has a resistance of 51Ω, and the third resistor 241 has a resistance of 2 KΩ. The capacitor 226 preferably has a capacitance of 47 μF and a rated voltage of 16 V. The transistor 211 can be a positive-negative-positive (PNP) transistor, such as a CHT2907 type transistor. A voltage $V_{be}$ between the base and emitter of the transistor 211 can be 0.7 V.

The DC-DC converting circuit 2 converts a high DC voltage to a low DC voltage by a series circuit comprised of the regulating circuit 21 and the bleeder circuit 23. In one example, an input voltage $V_i$ of 3.3 V is inputted to the input terminal 20, and a voltage of 2.6 V is supplied to the voltage-controlling terminal 26 to switch the transistor 211 to a conduction state. Then a voltage $V_{ec}$ between the emitter and collector of the transistor 211 is approximately equal to 0.9 V. The input voltage $V_i$ is pulled down 0.9 V via the emitter and the collector of the transistor 211, and then pulled down 0.6 V again via the bleeder circuit 23. Therefore, the output terminal 25 outputs an output voltage $V_o=V_i-V_{ec}-V_d=3.3-0.9-0.6=1.8$ V. Thus the DC-DC converting circuit 2 converts a high DC voltage of 3.3 V to a low DC voltage of 1.8 V. The range of the voltage being converted can be changed by changing the parameters of the elements that form the DC-DC converting circuit 2.

The DC-DC converting circuit 2 keeps the output voltage $V_o$ of the output terminal 25 constant by adjustment of the regulating circuit 21. When the output voltage $V_o$ rises abnormally, a voltage $V_c$ between two terminals of the capacitor 226 cannot change instantaneously. Then a voltage $V_{R2}$ of the second resistor 224 rises, the base voltage $V_b$ of the transistor 211 rises, and the voltage $V_{be}$ between the base and emitter of the transistor 211 drops. Therefore the base current $I_b$ falls, the collector current $I_c$ falls, the voltage $V_{ec}$ rises, and the output voltage $V_o$ drops. Conversely, when the output voltage $V_o$ drops abnormally, the voltage $V_{R2}$ of the second resistor 224 drops, the base voltage $V_b$ of the transistor 211 drops, and the voltage $V_{be}$ between the base and emitter of the transistor 211 rises. Therefore the base current $I_b$ rises, the collector current $I_c$ rises, the voltage $V_{ec}$ drops, and the output voltage $V_o$ rises. In this way, the DC-DC converting circuit 2 can output a stable output voltage $V_o$.

The DC-DC converting circuit 2 performs the function of converting a high DC voltage to a low DC voltage via utilizing a circuit made of ordinary discrete elements, such as resistors, capacitors, diodes, transistors, and so on. This makes the overall configuration of circuitry of the DC-DC converting circuit 2 relatively simple, and the cost of the DC-DC converting circuit 2 corresponding low.

Figure 2:
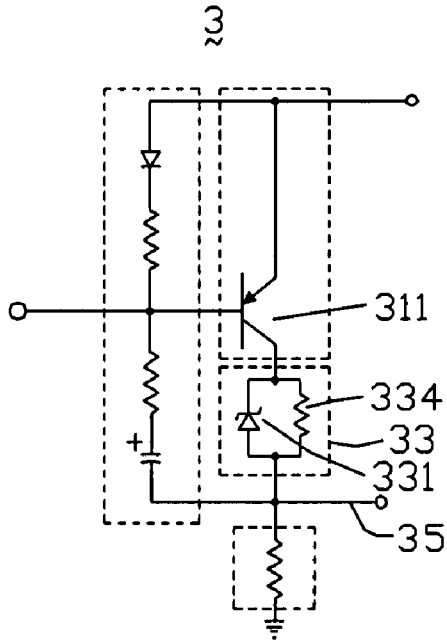
FIG. 2 is a diagram of a DC-DC converting circuit according to a second embodiment of the present invention.

Referring to FIG. 2, a DC-DC converting circuit 3 according to a second embodiment of the present invention is shown. The DC-DC converting circuit 3 is similar to the DC-DC converting circuit 2. However, a bleeder circuit 33 of the DC-DC converting circuit 3 includes a second diode 331 and a fourth resistor 334 connected in parallel. The second diode 331 can be a Zener diode, and includes an anode (not labeled) and a cathode (not labeled). The cathode of the second diode 331 is connected to a collector (not labeled) of a transistor 311, and the anode of the second diode 331 is connected to an output terminal 35. The bleeder circuit 33 supplies a stable divided voltage for the DC-DC converting circuit 3.

Figure 3:
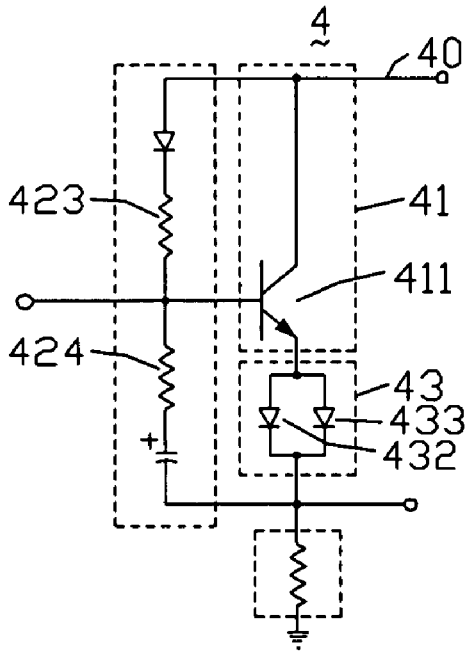
FIG. 3 is a diagram of a DC-DC converting circuit according to a third embodiment of the present invention.

Referring to FIG. 3, a DC-DC converting circuit according to a third embodiment of the present invention is shown. The DC-DC converting circuit 4 is similar to the DC-DC converting circuit 2. However, a regulating circuit 41 of the DC-DC converting circuit 4 includes a transistor 411. The transistor 411 can be a negative-positive-negative (NPN) transistor, and includes a base (not labeled), an emitter (not labeled), and a collector (not labeled). The base of the transistor 411 is connected between a first resistor 423 and a second resistor 424. The collector of the transistor 411 is connected to an input terminal 40. The emitter of the transistor 411 is collected to anodes of a second diode 432 and a third diode 433 of a bleeder circuit 43. The bleeder circuit 43 supplies a stable divided voltage for the DC-DC converting circuit 4.

Figure 4:
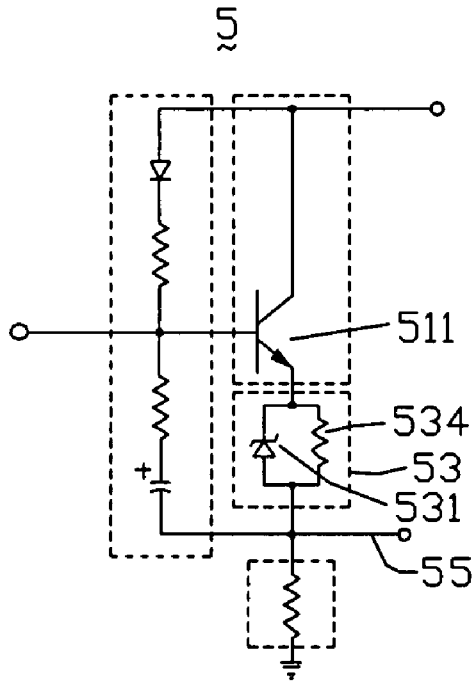
FIG. 4 is a diagram of a DC-DC converting circuit according to a fourth embodiment of the present invention.
Figure 5:
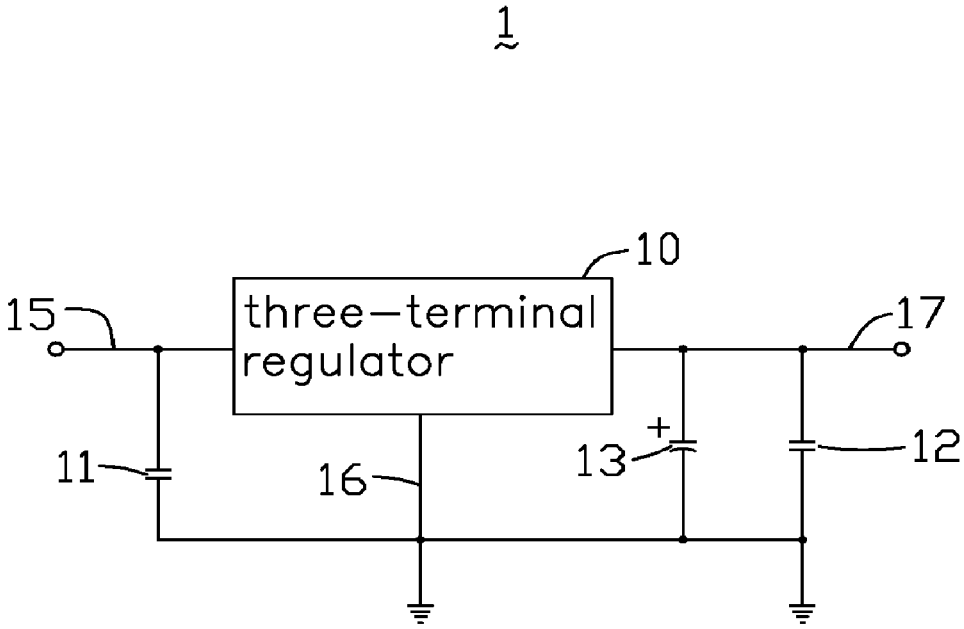
FIG. 5 (RELATED ART)
FIG. 5 is a diagram of a conventional DC-DC converting circuit.

Referring to FIG. 4, a DC-DC converting circuit 5 according to a fourth embodiment of the present invention is shown. The DC-DC converting circuit 5 is similar to the DC-DC converting circuit 4. However, a bleeder circuit 53 of the DC-DC converting circuit 5 includes a second diode 531 and a fourth resistor 534 connected in parallel. The second diode 531 can be a Zener diode, and includes an anode (not labeled) and a cathode (not labeled). The cathode of the second diode 531 is connected to an emitter (not labeled) of a transistor 511, and the anode of the second diode 531 is connected to an output terminal 55. The bleeder circuit 53 supplies a stable divided voltage for the DC-DC converting circuit 5.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A direct current-direct current (DC-DC) converting circuit, comprising:

an input terminal;

a regulating circuit;

a bleeder circuit configured to supply a stable divided voltage for the DC-DC converting circuit;

an output terminal;

a voltage-controlling terminal; and a load; wherein the regulating circuit comprises a transistor, the transistor comprises a base, an emitter, and a collector, the emitter is connected to the input terminal, the base is connected to the voltage-controlling terminal, the collector is connected to the output terminal via the bleeder circuit, and the output terminal is grounded via the load, the bleeder circuit comprises two diodes connected in parallel, each of the two diodes comprises an anode connected to the collector of the transistor, and a cathode connected to the output terminal.

2. The DC-DC converting circuit as claimed in claim 1, further comprising a biasing circuit connected between the input terminal and the output terminal, wherein the biasing circuit comprises a diode, a first resistor, a second resistor, and a capacitor connected in series, the diode comprises an anode connected to the input terminal, and a cathode connected to the first resistor, the base of the transistor is connected between the first and second resistors.

3. The DC-DC converting circuit as claimed in claim 2, wherein the capacitor is an electrolytic capacitor, the capacitor comprises an anode connected to the second resistor, and a cathode connected to the output terminal.

4. A direct current-direct current (DC-DC) converting circuit, comprising:

an input terminal;

a regulating circuit;

a bleeder circuit configured to supply a stable divided voltage for the DC-DC converting circuit;

an output terminal;

a voltage-controlling terminal; and a load; wherein the regulating circuit comprises a transistor, the transistor comprises a base, an emitter, and a collector, the collector is connected to the input terminal, the base is connected to the voltage-controlling terminal, the emitter is connected to the output terminal via the bleeder circuit, and the output terminal is grounded via the load; the bleeder circuit comprises a diode and a resistor connected in parallel.

5. The DC-DC converting circuit as claimed in claim 4, wherein the diode is a Zener diode, the diode comprises an anode connected to the output terminal, and a cathode connected to the emitter of the transistor.

6. The DC-DC converting circuit as claimed in claim 4, further comprising a biasing circuit connected between the input terminal and the output terminal, wherein the biasing circuit comprises a diode, a first resistor, a second resistor, and a capacitor connected in series, the diode comprises an anode connected to the input terminal, and a cathode connected to the first resistor, the base of the transistor is connected between the first and second resistors.

7. The DC-DC converting circuit as claimed in claim 6, wherein the capacitor is an electrolytic capacitor, the capacitor comprises an anode connected to the second resistor, and a cathode connected to the output terminal.

8. A direct current-direct current (DC-DC) converting circuit, comprising:

an input terminal;

a regulating circuit;

a bleeder circuit;

an output terminal;

a voltage-controlling terminal;

a load; and a biasing circuit connected between the input terminal and the output terminal; wherein the input terminal, the regulating circuit, the bleeder circuit, and the output terminal are connected in series, the output terminal is grounded via the load, the voltage-controlling terminal is configured to supply a controlling voltage that controls the regulating circuit, and the bleeder circuit is configured to supply a stable divided voltage to the output terminal for output; the biasing circuit is configured to cooperate with the regulating circuit to maintain an output voltage of the output terminal constant.

9. The DC-DC converting circuit as claimed in claim 8, wherein the bleeder circuit comprises two diodes connected in parallel, each of the two diodes comprises an anode connected to the collector of the transistor, and a cathode connected to the output terminal.

10. The DC-DC converting circuit as claimed in claim 8, wherein the bleeder circuit comprises a diode and a resistor connected in parallel.

11. The DC-DC converting circuit as claimed in claim 10, wherein the diode is a Zener diode, the diode comprises an anode connected to the output terminal, and a cathode connected to the collector of the transistor.

* * * * *